US009123457B2

(12) United States Patent
Kaga et al.

(10) Patent No.: US 9,123,457 B2
(45) Date of Patent: Sep. 1, 2015

(54) DIFFERENTIAL TRANSMISSION CABLE AND METHOD OF MANUFACTURING THE SAME

(71) Applicant: Hitachi Cable, Ltd., Tokyo (JP)

(72) Inventors: Masafumi Kaga, Hitachi (JP); Sohei Kodama, Hitachi (JP); Akinari Nakayama, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 197 days.

(21) Appl. No.: 13/788,329

(22) Filed: Mar. 7, 2013

(65) Prior Publication Data

US 2013/0233589 A1 Sep. 12, 2013

(30) Foreign Application Priority Data

Mar. 7, 2012 (JP) ..... 2012-050363
Jan. 15, 2013 (JP) ..... 2013-004286

(51) Int. Cl.

| | |
|---|---|
| ***H01B 7/00*** | (2006.01) |
| ***H01B 13/06*** | (2006.01) |
| ***H01B 13/14*** | (2006.01) |
| ***H01B 11/18*** | (2006.01) |
| *H01B 11/20* | (2006.01) |

(52) U.S. Cl.

CPC ..... *H01B 13/06* (2013.01); *H01B 7/00* (2013.01); *H01B 11/1839* (2013.01); *H01B 13/142* (2013.01); *H01B 11/20* (2013.01); *Y10T 29/49194* (2015.01)

(58) Field of Classification Search

CPC ..... H01B 7/00; H01B 13/00

USPC ..... 174/110 R, 110 PM, 113 R, 113 AS, 115, 174/116, 112, 110 F

See application file for complete search history.

(56) References Cited

U.S. PATENT DOCUMENTS

| | | | | |
|---|---|---|---|---|
| 5,283,390 | A * | 2/1994 | Hubis et al. | 174/36 |
| 6,403,887 | B1 * | 6/2002 | Kebabjian et al. | 174/110 R |
| 7,999,185 | B2 * | 8/2011 | Cases et al. | 174/113 R |
| 8,378,217 | B2 * | 2/2013 | Sugiyama et al. | 174/113 R |
| 8,440,910 | B2 * | 5/2013 | Nonen et al. | 174/115 |
| 8,546,691 | B2 * | 10/2013 | Watanabe et al. | 174/105 R |
| 2010/0300725 | A1 * | 12/2010 | Nakayama et al. | 174/110 SR |
| 2011/0083877 | A1 * | 4/2011 | Sugiyama et al. | 174/115 |
| 2011/0198106 | A1 * | 8/2011 | Sasamura et al. | 174/110 SR |
| 2012/0024566 | A1 * | 2/2012 | Shimosawa et al. | 174/107 |

FOREIGN PATENT DOCUMENTS

| | | | | |
|---|---|---|---|---|
| CN | WO2008/020694 | * | 2/2008 | H01B 13/016 |
| JP | 2001-035270 | * | 2/2001 | H01B 11/20 |
| JP | 2001-35270 A | | 2/2001 | |

* cited by examiner

*Primary Examiner* — William H Mayo, III
(74) *Attorney, Agent, or Firm* — McGinn IP Law Group, PLLC

(57) ABSTRACT

A differential transmission cable includes at least one pair of inner conductors arranged in parallel and extending parallel to each other, and a foamed insulating material formed on the inner conductors by a collective extrusion coating and molding of a resin material by using a chemical foaming method and have a variation of foaming degree of not more than 1%. The variation of foaming degree is defined as a difference between a maximum value and a minimum value among foaming degrees (%) of the foamed insulating material at 20 positions at intervals of 50 cm in a longitudinal direction in an arbitrary part of 10 m cut out from the differential transmission cable.

17 Claims, 5 Drawing Sheets

DIFFERENTIAL TRANSMISSION CABLE AND METHOD OF MANUFACTURING THE SAME

The present application is based on Japanese patent application Nos. 2012-050363 and 2013-004286 filed on Mar. 7, 2012 and Jan. 15, 2013, respectively, the entire contents of which are incorporated herein by reference.

BACKGROUND OF THE INVENTION

1. Field of the Invention

This invention relates to a differential transmission cable and a method of manufacturing the differential transmission cable.

2. Description of the Related Art

As a method of manufacturing a differential transmission cable, for example, there is a method configured such that a foamed insulating material is disposed directly above a dual core conductor by a collective extrusion for coating, particularly, such as a method described in JP-A-2001-035270. In the foam molding by a conventional single screw extruder such as that being used in the JP-A-2001-035270, the screw is composed of only metal and temperature control is mainly carried out in the cylinder part.

SUMMARY OF THE INVENTION

An extruder is configured to knead a resin by a screw while heating the resin by a heater installed in the cylinder. In the conventional single screw extruder, it is general that the cylinder temperature is not continuously designated, but is controlled by a heater installed in the outer periphery of the cylinder, and discretely designated according to approximately 5 to 10 zones. Accordingly, if a difference in the cylinder preset temperature in the zones adjacent to each other is large, the temperature gradient becomes steep and temperature of the resin becomes non-uniform, in association with this, viscosity of the resin also becomes non-uniform. In addition, in case of a chemical foam molding, a foaming agent is added to the resin at the time of kneading, thus if the viscosity thereof is non-uniform, dispersion state of the foaming agent in the extruder becomes worse. Furthermore, the non-uniform property of the resin temperature has an influence on the decomposition behavior of the foaming agent, and a decomposition gas may not sufficiently diffuse in the resin, as a result, the molded products are increased in a variation of foaming degree, so as to cause a non-uniform insulating performance in the whole length. In the above-mentioned conventional technique, production yield may be reduced for the reason of instability of the resin temperature due to the fact that the temperature gradient of the cylinder part is discontinuous. In particular, in the chemical foam molding, stability and control of the resin temperature are directly relating to stability of the foaming degree, thus accuracy is further needed.

Accordingly, it is an object of the invention to provide a differential transmission cable that is formed of a foamed insulating material to be small in variation of foaming degree in the longitudinal direction so as to provide a uniform insulating performance, as well as a method of effectively manufacturing the differential transmission cable.

(1) According to one embodiment of the invention, a differential transmission cable comprises:

at least one pair of inner conductors arranged in parallel and extending parallel to each other; and a foamed insulating material formed on the inner conductors by a collective extrusion coating and molding of a resin material by using a chemical foaming method and have a variation of foaming degree of not more than 1%, wherein the variation of foaming degree is defined as a difference between a maximum value and a minimum value among foaming degrees (%) of the foamed insulating material at 20 positions at intervals of 50 cm in a longitudinal direction in an arbitrary part of 10 m cut out from the differential transmission cable.

In the above embodiment (1) of the invention, the following modifications and changes can be made.

(i) The differential transmission cable further comprises:

an outer conductor configured to be disposed so as to coat the foamed insulating material; and an insulating jacket configured to be disposed so as to coat the outer conductor.

(ii) The differential transmission cable according to claim 1, wherein a skew of the cable is not more than 3 ps/m.

(2) According to another embodiment of the invention, a method of manufacturing a differential transmission cable comprises:

providing at least one pair of inner conductors arranged in parallel and extending parallel to each other; and accumulating or circulating a temperature gradient alleviating liquid of 95 to 130 degrees C. in or through a screw of a single screw extruder so as to planarize a temperature gradient of a resin material to which a chemical foaming agent is added, and in the state, forming a foamed insulating material on the inner conductors by applying a collective extrusion for coating and molding of the foamed resin material to the inner conductors.

EFFECTS OF THE INVENTION

According to one embodiment of the invention, a differential transmission cable can be provided that is formed of a foamed insulating material to be small in variation of foaming degree in the longitudinal direction so as to provide a uniform insulating performance, as well as a method of effectively manufacturing the differential transmission cable.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
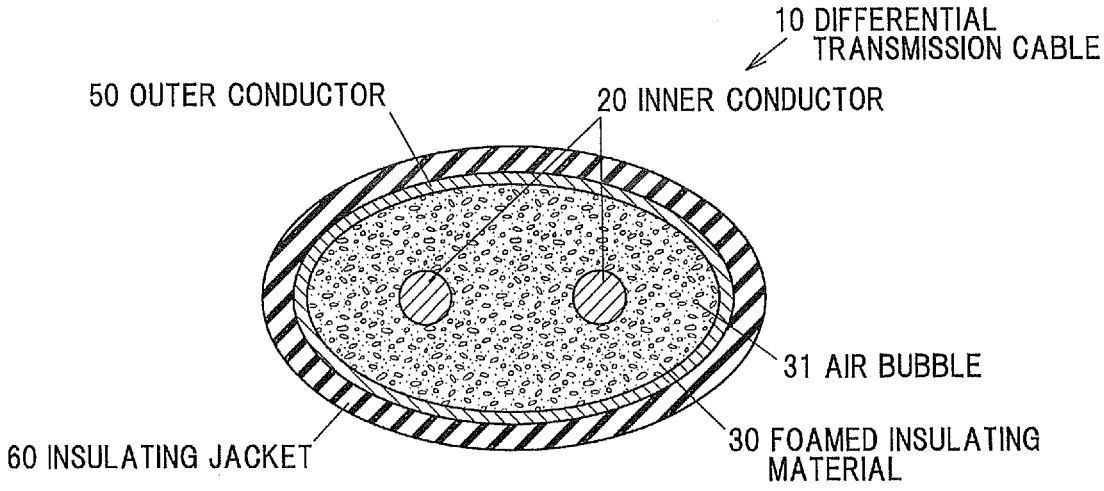
FIG. 1 is a cross-sectional view schematically showing a differential transmission cable according to a first embodiment of the invention.

The preferred embodiments according to the invention will be explained below referring to the drawings.

SUMMARY OF EMBODIMENTS

A differential transmission cable according to an embodiment of the invention includes at least one pair of inner conductors arranged in parallel and extending parallel to each other, and a foamed insulating material formed on the inner conductors by a collective extrusion coating and molding of a resin material by using a chemical foaming method and have a variation of foaming degree of not more than 1% per 10 m.

In addition, a method of manufacturing a differential transmission cable according to an embodiment of the invention includes providing at least one pair of inner conductors arranged in parallel and extending parallel to each other, and accumulating or circulating a temperature gradient alleviating liquid of 95 to 130 degrees C. in or through a screw of a single screw extruder so as to planarize a temperature gradient of a resin material to which a chemical foaming agent is added, and in the state, forming a foamed insulating material on the inner conductors by applying a collective extrusion for coating and molding of the foamed resin material to the inner conductors.

First Embodiment

As shown in FIG. 1, the differential transmission cable 10 according to the first embodiment is configured to include not less than one pair of inner conductors 20 configured to extend in parallel, and a foamed insulating material 30 configured to be disposed on the inner conductors 20, have air bubbles 31 formed by a chemical foaming method and have a variation of foaming degree (a difference between the maximum value and the minimum value of the foaming degrees (%) of the foamed insulating materials 30 in 20 places with respect to each 50 cm in the longitudinal direction in a part of 10 m in length cur out from an arbitrary place of the differential transmission cable 10) of not more than 1%, and is configured to further include an outer conductor 50 and an insulating jacket 60.

In the embodiment, in terms of reduction of skew (delay speed), ease of manufacture, reduction of production cost and the like, the process of coating the foamed insulating material on the inner conductors is carried out by using a collective extrusion for coating and molding in one extruder.

Conventionally, the differential transmission cable has been manufactured by coating a foamed insulating material on each inner conductor of not less than one pair of inner conductors so as to form a foamed insulated electric wire, and then winding an insulating tape or coating a non-foamed insulating material on two foamed insulated electric wires combined with each other so as to bundle the two foamed insulated electric wires in one body, after that forming an insulating jacket and the like. However, in this case, each foamed insulated electric wire is fabricated separately, thus the foaming degree of each foamed insulated electric wire in the same plane may be differentiated from each other. Namely, there is a problem that two foamed insulated electric wires are different in dielectric constant from each other, thus skew of the differential transmission cable manufactured is enlarged, so that transmission characteristics are lowered. For this reason, in the embodiment, the coating of the foamed insulating material on the inner conductors is formed by using the collective extrusion for coating and molding. In addition, by using the collective extrusion for coating and molding, instead of the conventional method that the coating processes of electric wire core and differential transmission cable are carried out separately, the manufacturing process can be carried out easily and the production cost can be reduced.

However, although a variation of foaming degree of the differential transmission cable in the same plane can be prevented by carrying out the collective extrusion for coating and molding, it is difficult to stabilize the foaming degree in the longitudinal direction of the cable, thus there is a problem, in terms of ease of manufacture, in particular, that a variation of foaming degree in the longitudinal direction of the cable is large. For this reason, a manufacturing method and a manufacturing process that are capable of maintaining a stable foaming state are needed.

As a foaming method of usual resin materials (for example, resin compositions), there are two methods of a physical foaming method and a chemical foaming method. The physical foaming method is configured to form air bubbles by dissolving a gas in a resin material that becomes a foamed material, and vaporizing the gas dissolved in the resin material by pressure release when the resin material is coated on the inner conductors. On the other hand, the chemical foaming method is configured to form air bubbles by kneading a chemical foaming agent in the resin material that becomes a foamed material, and generating a gas by thermal decomposition of the chemical foaming agent in the resin material. In the embodiment, as the foaming method of the foamed insulating material, the chemical foaming method is used.

The chemical foaming method is capable of forming air bubbles that have a smaller diameter in comparison with the physical foaming method. In addition, in case of the physical foaming method, the generation place and diameter of air bubbles may become non-uniform, if the resin material is collectively extruded for coating and molding on the core conductor, there is a problem that misalignment of the inner conductors and the like occur due to bias of the air bubble formation. On the other hand, in case of the chemical foaming method, the chemical foaming agent is uniformly dissolved in the resin material, thereby the air bubbles can be uniformly formed in the resin material, thus even if the resin material is collectively extruded for coating and molding on the dual-core conductor, variation of the two cores can be extremely lessened, so that low skew characteristics (low delay time difference characteristics) can be realized. Consequently, in the embodiment, the chemical foaming method is adopted.

In addition, a single screw extruder is used for extruding for coating of the foamed insulating material. In the chemical foaming method, it is necessary to control the decomposition of foaming agent by a temperature, but if a double-screw extruder or a multi-screw extruder is used, heat due to shear is heightened, thus it becomes difficult to control the decomposition of foaming agent. The single screw extruder generates the heat due to shear less than the double-screw extruder or the multi-screw extruder so as to control the decomposition of foaming agent more easily and effectively.

Figure 5:
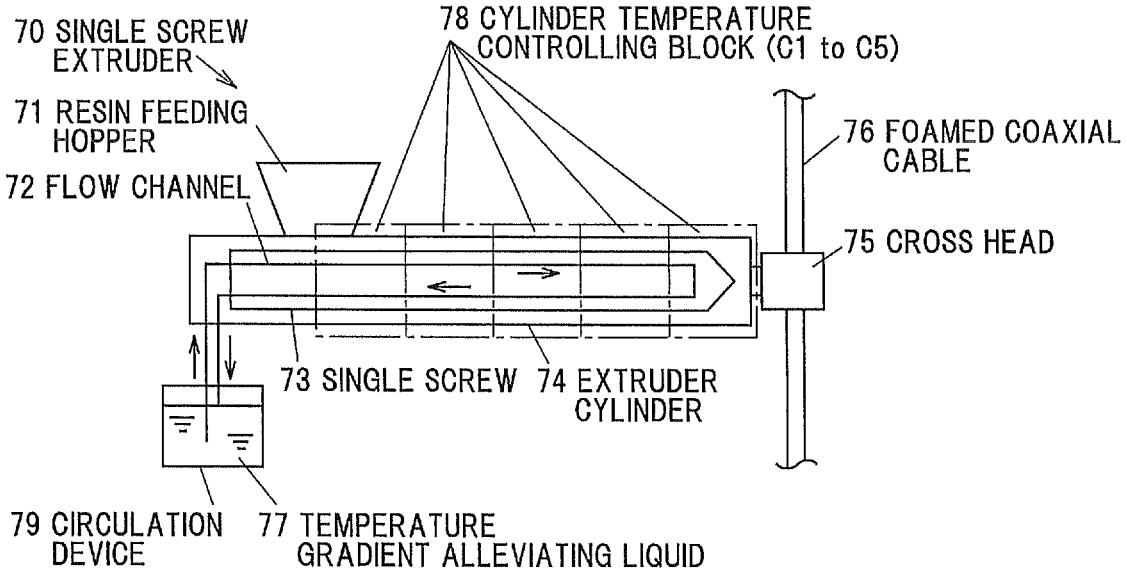
FIG. 5 is an explanatory view schematically showing a single screw extruder used when the differential transmission cable according to the embodiment of the invention is manufactured.

A configuration of a single screw extruder 70 used in the embodiment is shown in FIG. 5. A resin for chemical foaming supplied from a resin feeding hopper 71 is melted and kneaded by shear stress of a single screw 73 while being provided with heat from cylinder temperature controlling blocks (C1 to C5) 78 located outside of an extruder cylinder 74, and is transported to a cross head 75, so as to be coated on the inner conductors 20. Up to this point, the single screw extruder 70 has the same mechanism as the conventional single screw extruder, but in particular, the single screw extruder 70 is configured such that a flow channel 72 is formed in a single screw 73, and a temperature gradient alleviating liquid 77 is accumulated or circulated in or through the flow channel 72, for example, by a circulation device 79. It is preferable that the cylinder temperature controlling blocks (C1 to C5) 78 are appropriately adjusted according to the resin material and chemical foaming agent used and the foaming degree intended, and it is preferable that the vicinity of an extrusion opening (in the area near C4, C5) is controlled at 190 to 230 degrees C. If less than 190 degrees C., the viscosity of resin may be heightened, in addition, depending on the chemical foaming agent used, the decomposition temperature thereof may not be obtained, so that the foaming degree may be lowered and the moldability may be deteriorated. On the other hand, if more than 230 degrees C., burnt deposit may occur in the surface of the foamed insulating material, so that the appearance may be degraded.

Heat due to shear generated at the time of kneading by the single screw 73 and heat provided from the cylinder temperature controlling blocks (C1 to C5) 78 located outside of the extruder cylinder 74 are controlled by the temperature gradient alleviating liquid 77 accumulated or circulated in or through the flow channel 72 formed in the single screw 73, so as to allow the temperature gradient of the melted resin in the extruder cylinder 74 to be gentle or gradual, thereby the foaming agent is well dispersed in the melted resin so that the melted resin can be stably decomposed (gas can be stably generated). At the time, if only the external temperature adjustment is carried out as a conventional extruder, since each block of the cylinder temperature controlling blocks (C1 to C5) 78 has a discrete temperature, the temperature and viscosity of the melted resin are drastically changed with respect to each block of the cylinder temperature controlling blocks (C1 to C5) 78, thereby the chemical foaming agent in the melted resin is not stably decomposed and the decomposed gas is non-uniformly dispersed in the melted resin, so that the foaming degree cannot be stabilized. The circulation device 79 for circulating the temperature gradient alleviating liquid 77 is configured to have a pressure resistance structure of tight seal type for the purpose of accumulating or circulating a liquid having high pressure and temperature (low-pressure steam) in or through the flow channel 72 in the extruder cylinder 74, the structure being configured such that a hot water (low-pressure steam) of not less than 100 degrees C. can be also supplied thereto. The above-mentioned configuration is adopted, thereby the single screw extruder 70 can respond to any temperature rang.

As the screw piece, a commonly-used full flight structure or a screw configuration having a mixing zone can be used. It is preferable that the extruder cylinder 74 has a structure that the flow channel 72 is formed therein so that the temperature gradient alleviating liquid 77 can be circulated, and heat transport in the axis direction of the single screw 73 can be effectively carried out by the temperature gradient alleviating liquid 77, and the above-mentioned structure has an effect on smoothing the temperatures of cylinder temperature controlling blocks (C1 to C5) 78.

As the temperature gradient alleviating liquid 77 configured to be accumulated or circulated in or through the flow channel 72 in the extruder cylinder 74, water or heat transfer oil can be used. It is necessary to change the temperature setting of the temperature gradient alleviating liquid 77 according to the melting point of the resin material (the temperature in the extruder). It is preferable that the temperature control is carried out at a temperature adjacent to the melting point of the resin material.

As the resin material, for example, polyolefin can be used, and if the resin has a unit obtained by polymerizing olefin, it can be used without particular limitation, and it includes low-density polyethylene, high-density polyethylene, linear low-density polyethylene, ultralow density polyethylene, ethylene-hexane copolymer, ethylene-octene copolymer, ethylene-vinyl acetate copolymer, ethylene-ethyl acrylate copolymer, ethylene-methyl acrylate copolymer, ethylene-methyl methacrylate copolymer, polypropylene, ethylene copolymer polypropylene, and reactor blend type polypropylene. Those can be used either alone or in a blend of not less than two.

As the chemical foaming agent, it is selected so as to fit the molding temperature of the resin, a chemical foaming agent that has a decomposition temperature of 190 to 220 degrees C. can be used. For example, the chemical foaming agent includes (A) an organic chemical foaming agent such as azodicarbonamide, azobisisobutyronitrile, barium azodicarboxylate, dinitrosopentamethylenetetramine, 4,4'-oxybis (benzenesulfonylhydrazide), N,N'-dinitrosopentamethylenetetramine, benzenesulfonylhydrazide, bistetrazole diammonium, bistetrazole piperazine, 5-phenyltetrazole; (B) an inorganic chemical foaming agent such as carbonate, bicarbonate, nitrite, hydride; and (C) an auxiliary foaming agent such as metal oxide (such as zinc oxide, magnesium oxide), fatty acid salt, inorganic zinc compound, urea-based compound, organic acid, amine compound. Those can be used either alone or in a blend of not less than two.

In the dual-core cable for differential transmission, the stability of foaming degree becomes more important in comparison with a single-core coaxial cable. In the differential transmission, it is ideal that the two cores have the same electric characteristics with each other. If the foaming degree is varied, a variation in electric characteristics (circuit distributed constant) occurs between the two cores or in the longitudinal direction of the cable, so as to cause an increase in skew. In order to obtain good electric characteristics as the differential transmission cable, skew (delay time difference) is preferably not more than 5 ps/m, and more preferably not more than 3 ps/m. In order to control the value of skew so as not to become a problematic value, namely control it to be not more than 5 ps/m, the variation of foaming degree is not more than 2% over the longitudinal direction of the cable, and preferably not more than 1% for keeping tolerance. Here, the variation of foaming degree means a difference between the maximum value and the minimum value of the foaming degrees (%) of the foamed insulating materials in 20 places with respect to each 50 cm in the longitudinal direction in a part of 10 m in length cut out from an arbitrary place of the differential transmission cable. In addition, in a single-core coaxial cable, if the variation of foaming degree is small, impedance is stabilized and production yield can be extremely improved, thus the manufacturing method of the invention can be also applied to the manufacture of the single-core coaxial cable.

Figure 2:
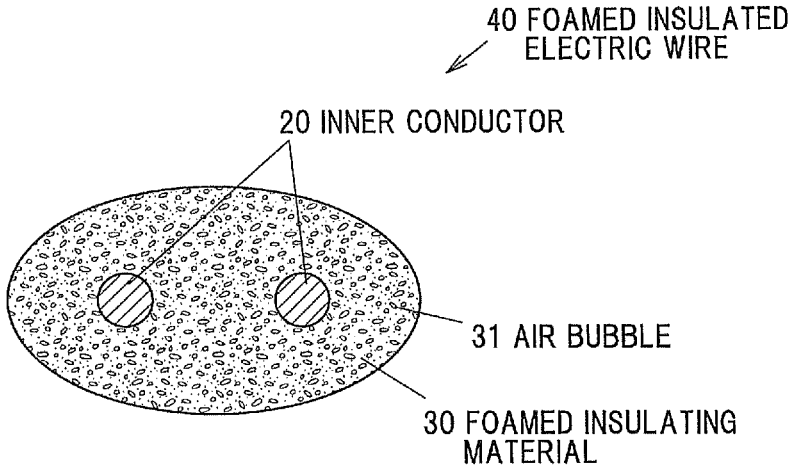
FIG. 2 is a cross-sectional view schematically showing a foamed insulated electric wire used in the first embodiment of the invention.

As shown in FIG. 2, the foamed insulated electric wire 40 is configured such that a foamed insulating material 30 having a plurality of air bubbles 31 is disposed on inner conductors 20 by a collective extrusion for coating and molding.

The inner conductor 20 can be comprised of either a single wire or a twisted wire, and can be comprised of copper, and various alloy wires other than copper, and according to circumstances, a tubular inner conductor can be also used. In addition, arbitrary plating such as silver, tin, nickel, gold and the like can be applied to the surface thereof.

Figure 4:
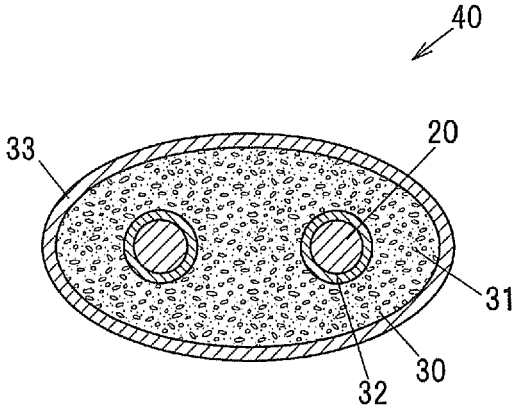
FIG. 4 is a cross-sectional view schematically showing a foamed insulated electric wire used in the second embodiment of the invention.

The foamed insulating material 30 including the air bubbles 31 can be comprised of either a single layer or a multi-layer of a plurality of foamed layers. In addition, as shown in FIG. 4, an inner skin layer 32 and an outer skin layer 33 can be disposed on the inner periphery and the outer periphery of the foamed insulating material 30 as a skin layer, the inner skin layer 32 and an outer skin layer 33 being not foamed or having a foaming degree smaller than the foamed insulating material 30.

In addition, the outer conductor 50 formed on the outer periphery of the foamed insulating material 30 or the outer skin layer 33 can be comprised of arbitrary one selected from a group consisting of spiral wrap or braid of ultrafine metal wire, winding of metal foil, corrugated structure of metal and the like according to the application and need.

The material of the insulating jacket 60 formed further outside of the outer conductor 50 is not particularly limited, but for example, materials such as polyolefin (such as polyethylene, polypropylene, ethylene-vinyl acetate copolymer); fluorine resin; soft vinyl chloride resin can be used.

Regardless of presence or absence of the outer conductor 50, the configuration of the foamed insulated electric wire 40 can be also arbitrarily selected.

In order to allow the outer shield to connect to ground, a drain wire (not shown) can be disposed between the outer conductor 50 and the foamed insulating material 30 or between the outer conductor 50 and the insulating jacket 60.

Second Embodiment

Figure 3:
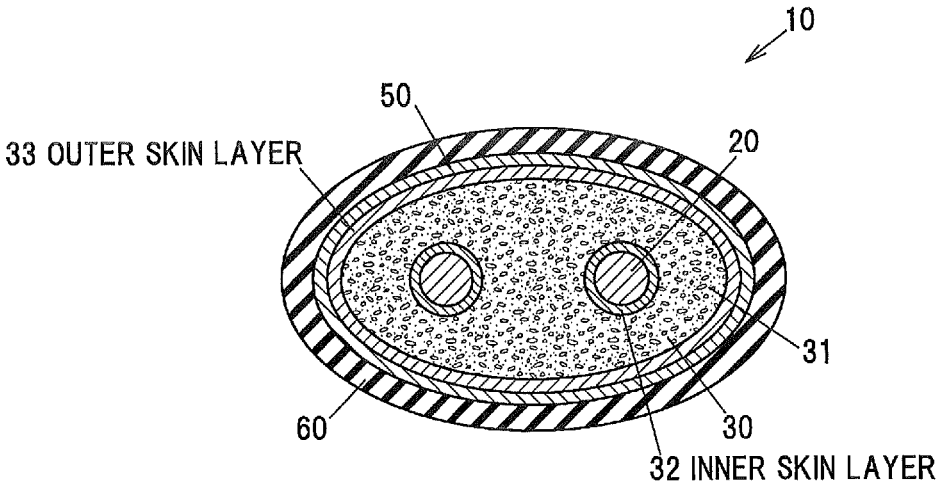
FIG. 3 is a cross-sectional view schematically showing a differential transmission cable according to a second embodiment of the invention.

As shown in FIG. 3, the differential transmission cable 10 according to the second embodiment is configured to include not less than one pair of inner conductors 20 configured to extend in parallel, a foamed insulating material 30 configured to be disposed on the inner conductors 20, have air bubbles 31 formed by a chemical foaming method and have a variation of foaming degree (a difference between the maximum value and the minimum value of the foaming degrees (%) of the foamed insulating materials 30 in 20 places with respect to each 50 cm in the longitudinal direction in a part of 10 m in length cur out from an arbitrary place of the differential transmission cable 10) of not more than 1%, an outer conductor 50 and an insulating jacket 60, and is configured to further include an inner skin layer 32 disposed on the outer periphery of the inner conductors 20 and an outer skin layer 33 disposed on the outer periphery of the foamed insulating material 30. Namely, the differential transmission cable 10 of the second embodiment differs from the differential transmission cable 10 of the first embodiment only in being configured to use the foamed insulated electric wire 40 shown in FIG. 4 instead of the foamed insulated electric wire 40 shown in FIG. 2.

EXAMPLES

Hereinafter, the differential transmission cable of the invention will be explained further in detail by using Examples. Further, the invention is not subject to any limitation by the following Examples.

Example 1

A foamed electric wire was fabricated by using a 45 mm extruder that has a mouse piece with elliptical opening. Water was used as a temperature gradient alleviating liquid in a screw. Polyethylene as a resin material and azodicarbonamide (ADCA) as a chemical foaming agent were used, and the additive amount of azodicarbonamide (ADCA) was set to 1% by mass relative to the resin. The cable was manufactured by collectively extruding the resin on two cores of 24 AWG silver plated copper conductor, and continuously operating for 2 hours while the screw revolution and linear speed were adjusted in such a way that the major axis and minor axis of the outer diameter of the cable became 3.00 mm and 1.55 mm. Table 1 shows cylinder temperature conditions (extruder cylinder temperature and water temperature in screw) in Examples and Comparative Examples, and in case of Example 1, cylinder temperature condition A was used.

TABLE 1

| | | Cylinder temperature condition | | | | |
|---|---|---|---|---|---|---|
| | | A | B | C | D | E |
| Cylinder temperature (degrees C.) | C1 | 150 | 140 | 130 | 190 | 150 |
| | C2 | 190 | 170 | 170 | 190 | 160 |
| | C3 | 210 | 200 | 190 | 190 | 170 |
| | C4 | 220 | 220 | 220 | 190 | 180 |
| | C5 | 220 | 220 | 220 | 190 | 190 |

In particular, it is preferable that the water temperature in the screw falls within the range of not less than 95 degrees C., if less than 95 degrees C., the temperature in the cylinder becomes instable due to an influence of the temperature gradient, variation in a decomposition amount of the foaming agent and viscosity of the resin occurs with respect to each temperature controlling block of the cylinder, and gas is not uniformly dispersed in the cylinder of the extruder, as a result, the foaming degree becomes instable. In addition, if more than 130 degrees C., the foaming agent adheres to the surface of the screw, appearance defect occurs due to burnt deposit. It is more preferable that the water in the screw falls within the range of 105 to 130 degrees C.

The foaming degree was obtained as a foaming degree of the foamed insulating material in the whole length of the manufactured differential transmission cable by measuring capacitance when the foamed insulating material was coated on the dual-core conductor. Tables 2 and 3 show the maximum foaming degree and the minimum foaming degree obtained at the above-mentioned time. The measurement in this case was carried out, for example, in such a way that the foamed insulating material and the skin layers that became insulating materials were simultaneously extruded on the dual-core conductor, and then the capacitance was measured by using a capacitance measurement device installed in a part of a cooling water tank. The capacitance can be continuously measured by in-line measurement. The foaming degree (%) shown in Tables 2 and 3 means the maximum foaming degree and the minimum foaming degree measured by the capacitance measurement device, of all cables manufactured by carrying out the coating process for 2 hours in Examples.

Next, a part of 10 m in length was pulled out of an arbitrary place of the cables manufactured for the purpose of measuring the variation of foaming degree of the differential transmission cable on which the insulating material was coated, and the part was cut into two pieces from the center along the direction of the inner conductor. Next, the skin layers and inner conductors were removed from the differential transmission cable of 10 m in length. In addition, 20 samples were cut out from the foamed insulating material 30 after the inner conductors and the like were removed with respect to each 50 cm in the longitudinal direction, and then specific gravity (density of polyethylene) was measured by Archimedes method or density gradient of the insulating material so as to calculate the foaming degree F. (%) of the respective 20 samples in the range of the part of 10 m in length cut out by the following formula (I).

$$F=(1-\sigma_f/\rho_p)\times 100 \quad (1)$$

Further, in the formula (I), $\rho_f$ represents a density of polyethylene foamed material, and $\rho_p$ represents a density of polyethylene.

A difference between the maximum value and the minimum value of the foaming degrees (%) in 20 places with respect to each 50 cm in the longitudinal direction in a part of 10 m in length cur out arbitrarily is defined as a variation of foaming degree. Namely, the variation of foaming degree means a variation of foaming degree within the range of 10 m of the differential transmission cable manufactured by Examples. It is preferable that the variation of foaming degree in the longitudinal direction is smaller, thus the fact that the variation of foaming degree (%) is small means that air bubbles are formed so as to be uniformly dispersed in the foamed insulating material, and the insulation performance is also homogenized, so as to become advantageous to improving in skew (delay time difference) characteristics of the differential transmission cable.

In the invention, it is preferable that the variation of foaming degree (%) is not more than 1% in terms of skew, and the fact of being not more than 1% has an effect on improving in skew characteristics of the differential transmission cable.

Each 30 m of a dual-core parallel coaxial cable was manufactured by winding a laminated tape configured such that a copper tape and a polyester film are laminated with each other around the above-mentioned foamed electric wire so as to form an outer conductor as a shield layer, and further coating the outside of the outer conductor with a soft polyvinyl chloride resin so as to form an insulating jacket. The coaxial cable of 30 m in length manufactured was cut out with respect to each 5 m so as to obtain 6 pieces of cable, and skew of each piece of cable was measured by a time-domain reflectometer (TDR).

The extrusion appearance was visually evaluated. Table 2 shows the measurement and evaluation results.

TABLE 2

| | Example | | | | | | | |
|---|---|---|---|---|---|---|---|---|
| | 1 | 2 | 3 | 4 | 5 | 6 | 7 | 8 |
| Cylinder temperature condition | A | A | A | B | B | C | C | C |
| Water temperature in screw (degrees C.) | 95 | 105 | 120 | 95 | 110 | 95 | 120 | 130 (Oil temp.) |
| Foaming degree (%) | 49.1 to 52.3 | 49.6 to 52.2 | 51.2 to 53.9 | 48.6 to 52.0 | 48.8 to 51.9 | 47.4 to 50.8 | 48.5 to 51.2 | 50.1 to 52.1 |
| Variation of foaming degree (%) | 0.97 | 0.80 | 0.89 | 1.00 | 0.95 | 1.00 | 0.89 | 0.55 |
| Skew (ps/m) | 2.8 | 2.1 | 2.3 | 2.8 | 2.6 | 2.9 | 2.5 | 1.8 |
| Extrusion appearance | Good | Good | Good | Good | Good | Good | Good | Good |

Oil temp.: Heat transfer oil temperature

As mentioned above, in case of Example 1, the cylinder temperature condition was set to A shown in Table 1 and the temperature gradient alleviating liquid in the screw was set to 95 degrees C. A difference between the cylinder temperatures was relaxed, thereby the viscosity of melted resin was appropriately lowered and the foaming agent in the melted resin was improved in dispersibility, thus the variation of foaming degree was inhibited to 0.97, in association with this, skew became 2.8 ps/m that was less than 3 ps/m. In addition, the extrusion appearance was good.

Example 2

As shown in Table 2, Example 2 was carried out similarly to Example 1 except for changing the water temperature in the screw to 105 degrees C. Table 2 shows the measurement and evaluation results.

Example 3

As shown in Table 2, Example 3 was carried out similarly to Example 1 except for changing the water temperature in the screw to 120 degrees C. Table 2 shows the measurement and evaluation results.

Example 4

As shown in Table 2, Example 4 was carried out similarly to Example 1 except for changing the cylinder temperature condition to B shown in Table 1 and changing the water temperature in the screw to 95 degrees C. Table 2 shows the measurement and evaluation results.

Example 5

As shown in Table 2, Example 5 was carried out similarly to Example 1 except for changing the cylinder temperature condition to B shown in Table 1 and changing the water temperature in the screw to 110 degrees C. Table 2 shows the measurement and evaluation results.

Example 6

As shown in Table 2, Example 6 was carried out similarly to Example 1 except for changing the cylinder temperature condition to C shown in Table 1 and changing the water temperature in the screw to 95 degrees C. Table 2 shows the measurement and evaluation results.

Example 7

As shown in Table 2, Example 7 was carried out similarly to Example 1 except for changing the cylinder temperature condition to C shown in Table 1 and changing the water temperature in the screw to 120 degrees C. Table 2 shows the measurement and evaluation results.

Example 8

As shown in Table 2, Example 8 was carried out similarly to Example 1 except for changing the cylinder temperature condition to C shown in Table 1 and changing the temperature gradient alleviating liquid in the screw from water to heat transfer oil having a temperature of 130 degrees C. Table 2 shows the measurement and evaluation results. The temperature gradient of the cylinder was larger than A and B shown in Table 1, but the temperature difference in the cylinder was alleviated by the heat transfer oil, thereby the variation of foaming degree was inhibited, in association with this, skew became 1.8 ps/m.

Comparative Example 1

As shown in Table 3, Comparative Example 1 was carried out similarly to Example 1 except for changing the water temperature in the screw to 70 degrees C. Table 3 shows the measurement and evaluation results. The resin adjacent to the surface of the screw was cooled and heat was deprived, thereby the temperature became non-uniform, thus the variation of foaming degree was increased to 1.25%.

TABLE 3

| | Comparative Example | | | | | | |
|---|---|---|---|---|---|---|---|
| | 1 | 2 | 3 | 4 | 5 | 6 | 7 |
| Cylinder temperature condition | A | A | A | B | C | D | E |
| Water temperature in screw (degrees C.) | 70 | 140 | NO | NO | NO | Resin material blocked and kneading impossible | NO |
| Foaming degree (%) | 46.3 to 51.6 | 52.7 to 55.9 | 53.1 to 58.6 | 51.5 to 58.7 | 50.1 to 59.1 | | 24.1 to 28.4 |
| Variation of foaming degree (%) | 1.25 | 1.02 | 1.27 | 1.46 | 1.63 | | 1.12 |
| Skew (ps/m) | 4.2 | 2.6 | 7.4 | 12.9 | 15.2 | | 3.1 |
| Extrusion appearance | Good | Burnt deposit | Burnt deposit | Burnt deposit | Burnt deposit | | Good |

NO: screw without flow channel was used.
Burnt deposit: occurrence of burnt deposit Comparative Example 2

As shown in Table 3, Comparative Example 2 was carried out similarly to Example 1 except for changing the water temperature in the screw to 140 degrees C. Table 3 shows the measurement and evaluation results. The temperature was too high, thus the extrusion appearance was worsened due to burnt deposit.

Comparative Example 3

As shown in Table 3, Comparative Example 3 was carried out similarly to Example 1 except for using a screw without a flow channel (in Table 3, "water temperature in screw" was shown as "NO"). Table 3 shows the measurement and evaluation results. The temperature gradient of the cylinder was not alleviated, thereby the variation of foaming degree was increased, in association with this, the surface temperature of the screw was raised as the time passed, thus burnt deposit occurred and the extrusion appearance was worsened.

Comparative Example 4

As shown in Table 3, Comparative Example 4 was carried out similarly to Example 1 except for changing the cylinder temperature condition to B shown in Table 1 and using the screw without the flow channel. Table 3 shows the measurement and evaluation results. The temperature gradient of the cylinder was not alleviated, thereby the variation of foaming degree was increased, in association with this, the surface temperature of the screw was raised as the time passed, thus burnt deposit occurred and the extrusion appearance was worsened.

Comparative Example 5

As shown in Table 3, Comparative Example 5 was carried out similarly to Example 1 except for changing the cylinder temperature condition to C shown in Table 1 and using the screw without the flow channel. Table 3 shows the measurement and evaluation results. The temperature gradient of the cylinder was not alleviated, thereby the variation of foaming degree was increased, in association with this, the surface temperature of the screw was raised as the time passed, thus burnt deposit occurred and the extrusion appearance was worsened.

Comparative Example 6

As shown in Table 3, Comparative Example 6 was carried out similarly to Example 1 except for changing the cylinder temperature condition to D shown in Table 1 and using the screw without the flow channel. Table 3 shows the measurement and evaluation results. The cylinder was not configured to have a temperature gradient, thus the resin material was melted in the extruder immediately after being fed from the hopper, consequently, it became blocked at the entrance of the hopper, so as not to be extruded.

Comparative Example 7

As shown in Table 3, Comparative Example 7 was carried out similarly to Example 1 except for changing the cylinder temperature condition to E shown in Table 1 and using the screw without the flow channel. Table 3 shows the measurement and evaluation results. In order to alleviate the temperature gradient of the cylinder, the cylinder temperature was set to not more than 200 degrees C., thus the foaming degree became too low and the foaming agent was not sufficiently decomposed, so that the variation of foaming degree was increased.

In addition, in terms of the maximum and minimum foaming degrees (%) in the differential transmission cable manufactured continuously for 2 hours, it was confirmed that the foamed insulating materials of Examples were capable of further inhibiting the variation of foaming degree in comparison with those of Comparative Examples.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A method of manufacturing a differential transmission cable, the method comprising:

providing at least one pair of inner conductors arranged side by side and extending parallel to each other;

accumulating or circulating a temperature gradient alleviating liquid of 95 degrees C. to 130 degrees C. in or through a screw of a single screw extruder so as to planarize a temperature gradient of a resin material to which a chemical foaming agent is added; and extrusion-coating and molding the foamed resin material around the inner conductors together, to thereby arrange a foamed insulating material around the inner conductors, wherein a variation of a degree of foaming of the foamed insulating material is within 1%.

2. The method according to claim 1, wherein a vicinity of an extrusion opening is controlled at 190 degrees C. to 230 degrees C.

3. The method according to claim 1, wherein the single screw extruder is being provided with a multiplicity of cylinder temperature controlling blocks.

4. The method according to claim 3, wherein the cylinder temperature controlling blocks are controlled at their respective discrete temperatures.

5. The method according to claim 1, further comprising:

arranging an outer conductor so as to coat the foamed insulating material; and arranging an insulating jacket so as to coat the outer conductor.

6. The method according to claim 1, wherein a resulting cable has a skew of not more than 3 ps/m.

7. The method according to claim 1, wherein the variation of the degree of foaming is defined as a difference between a maximum value and a minimum value among foaming degrees of the foamed insulating material at positions in a longitudinal direction in an arbitrary part cut out from the differential transmission cable.

8. The method according to claim 1, wherein the variation of the degree of foaming is defined as a difference between a maximum value and a minimum value among foaming degrees of the foamed insulating material at 20 positions at intervals of 50 cm in a longitudinal direction in an arbitrary part of 10 m cut out from the differential transmission cable.

9. The method according to claim 1, wherein the foamed insulating material includes air bubbles formed by the chemical foaming agent.

10. The method according to claim 1, wherein the extrusion-coating and molding of the foamed resin material are performed collectively by a collective extrusion.

11. The method according to claim 10, wherein the collective extrusion includes a chemical foaming to form air bubbles by kneading the chemical foaming agent in the resin material to the foamed resin material.

12. The method according to claim 11, wherein the collective extrusion further includes generating a gas by a thermal decomposition of the chemical foaming agent in the resin material.

13. The method according to claim 1, wherein the extrusion-coating and molding includes a chemical foaming to form air bubbles by kneading the chemical foaming agent in the resin material to form the foamed resin material.

14. The method according to claim 13, wherein the extrusion-coating and molding further includes generating a gas by a thermal decomposition of the chemical foaming agent in the resin material.

15. The method according to claim 1, wherein the chemical foaming agent has a decomposition temperature of 190 degrees C. to 220 degrees C.

16. The method according to claim 1, further comprising:

forming an inner skin layer between a surface of the inner conductors and an inner periphery of the foamed resin material.

17. The method according to claim 16, further comprising:

forming an outer skin layer on an outer periphery of the foamed resin material;

forming an outer conductor on the outer skin layer; and forming an insulating jacket on the outer conductor.

* * * * *